US005156120A

United States Patent [19]

Kent

[11] Patent Number: 5,156,120

[45] Date of Patent: Oct. 20, 1992

[54] ENGINE PRE-OILER

[75] Inventor: Fred M. Kent, Hobe Sound, Fla.

[73] Assignee: William H. Benson, Port St. Lucie, Fla.

[21] Appl. No.: 834,628

[22] Filed: Feb. 12, 1992

[51] Int. Cl.[5] ..... F01M 1/18

[52] U.S. Cl. ..... 123/196 S; 184/6.3

[58] Field of Search ..... 123/196 R, 196 S; 184/6.3; 251/30.03

[56] References Cited

U.S. PATENT DOCUMENTS

| | | | |
|---|---|---|---|
| 2,755,787 | 7/1956 | Butler | 123/196 S |
| 2,815,921 | 12/1957 | Bigelow | 251/30.3 |
| 2,889,821 | 6/1959 | Maki | 123/196 S |
| 3,076,630 | 2/1963 | Hammond | 251/30.3 |
| 3,556,070 | 12/1971 | Holcomb | 123/196 S |
| 3,583,525 | 6/1971 | Holcomb | 123/196 S |
| 3,738,607 | 6/1973 | Peruglia | 251/30.3 |
| 4,061,204 | 12/1977 | Kautz, Jr. | 123/196 S |
| 4,703,727 | 11/1987 | Cannon | 123/196 S |
| 5,014,820 | 5/1991 | Evans | 123/196 S |
| 5,069,177 | 12/1991 | Dokonal | 123/196 S |

*Primary Examiner*—Tony M. Argenbright
*Assistant Examiner*—Erick Solis

[57] ABSTRACT

An accumulator for withdrawing and holding lubricant under pressure and returning the same to the lubrication system of an internal combustion engine that includes a spring loaded closed pintle valve cooperating with the accumulator reservoir that is opened by energizing a solenoid in response to initiating the starting of the engine to inject lubricant back into the engine adjacent the moving parts of the engine. A check valve through a central passageway internally of the pintle valve loads the lubricant from the engine into the reservoir and maintains its pressure until the cycle is repeated.

10 Claims, 10 Drawing Sheets

Optional Method Open
for Methanol Engines

ENGINE PRE-OILER

Technical Field

This invention relates to prelubrication means for an internal combustion engine and particularly to means for admitting pressurized lubricant into the existing lubrication system of that engine prior to start-up.

Background of the Invention

It is well known that start-up operation of an internal combustion engine contributes most to the wear and tear of its moving parts because the absence of lubricant at that time. Obviously, at shutdown after the engine is at rest for some time the oil due to gravity drains to the bottom of the engine and these parts when restarted run virtually dry until such time as the engine' oil pump has developed sufficient pressure to return the lubricant to these parts.

A considerable number of patents disclose systems that address this problem and attempt to solve it. A host of these prior art patents describing representative systems are disclosed in U.S. Pat. No. 5,069,177 granted to J. Dokonal on Dec. 3, 1991. This patent likewise describes a prelubrication system that includes a solenoid spring biased valve that opens and closes a pressure driven oil reservoir upon actuation of the solenoid. Pressurization is obtained from a pressure driven diaphragm in the reservoir. Oil is fed to the engine's oil galley and returned to the reservoir when the engine becomes operative and the engine pressure is raised by rerouting the oil back through the same conduit and passageways.

Another example of a prior art prelubricating system is described in U.S. Pat. No. 4,061,204 granted to W. C Kautz, Jr. on Dec. 6, 1977. This system utilizes a spring biased closed valve associated with the accumulator reservoir and a integral return restrictive passageway for refilling the reservoir with engine oil. A separate solenoid valve is used to connect and disconnect both the biased valve and restrictive passageway to and from the engine's lubricating system. As in other prior art patents, the reservoir is divided into subchambers by a flexible diaphragm which serves to force the oil back into the engine.

While some of these types of systems have been commercially acceptable they have all been exceedingly expensive and hence do not meet the needs of a certain part of the market. The reason for their being unacceptable is because they are either complex and/or require many parts. Or individual parts are too expensive to fabricate and the like. For example the force level needed to translate the valve may require an excessively large solenoid which is inherently more expensive. The use of a separate pumping system to pressurize the accumulator as is required in some of these prior art systems increases the cost.

My invention is characterized as being relatively simple in design requiring just two moving parts and relatively easy to fabricate and assemble and consequently relative inexpensive to produce. Because the valve body is nonmagnetic and the needle valve is fabricated from a magnetic material and is operative by the solenoid directly, the energy goes entirely into the needle valve and hence, is not dissipated by the valve body. The needle valve, check valve and the restrictive passageway are formed integrally in a single valve housing and the check valve is formed within the needle valve itself. The steel accumulator bottle is in existence and requires minor modifications as would be required if the present invention relied on a separate power source to force the oil out of the accumulator. Alternatively the bottle can be fabricated and made integral with the valva body. All of these feature in one way or an other contribute to the low cost of my apparatus.

DISCLOSURE OF INVENTION

An object of this invention is to provide an improved prelubrication accumulator system that is characterized by its simplicity to manufacture and assemble and its low cost.

A feature of this invention is the inclusion of a check valve within a biased closed needle valve that cooperates with a restrictive passageway for refilling the accumulator's reservoir and maintaining a predetermined maximum pressure constituting the only moving parts in the system.

Another feature of this invention is to provide a simple electrical circuit with or without an electrical relay or temperature override adapting the system to be manually or automatically operable and useable in land or water operated vehicles.

Another feature of this invention is the inclusion of a feed line connection from the accumulator for use in an engine fueled be methanol.

Another feature of this invention is the utilization of available steel cylindrical bottles used for propane gas (or inexpensive to make ones) that are oriented vertically relative to the earth's horizon with the opening at the bottom to the bottle so that a pocket of air is trapped at the top as the bottle fills which serves as the motivating force to feed the lubricant back to the engine's moving parts.

Other features and advantages will be apparent from the specification and claims and from the accompanying drawings which illustrate an embodiment of this invention.

BEST MODE FOR CARRYING OUT THE INVENTION

As noted in the above this invention serves to raise the oil pressure of the internal combustion engine sufficiently to lubricate the moving parts prior to starting the engine. While this invention in its preferred embodiment is utilized wit an internal combustion engine, it will be appreciated by those skilled in this art that this invention has utility for other types of engines or motors so long as they are of the type that require oil pressure to lubricate the moving parts.

Figure 1:
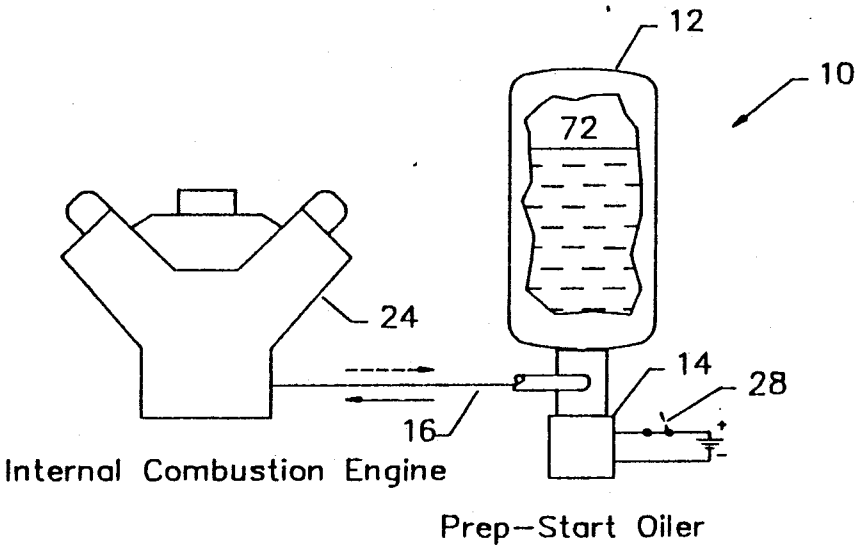
FIG. 1 is a schematic illustration of the inventive prelubrication system as connected to an internal combustion engine.
Figure 2:
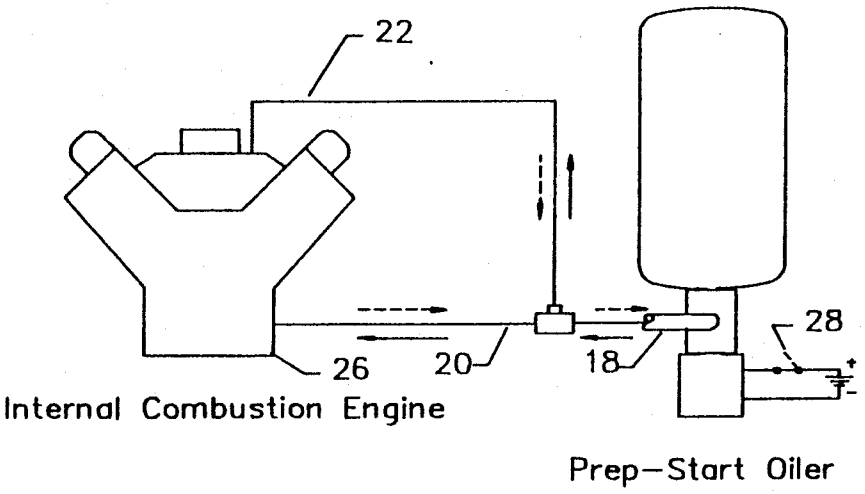
FIG. 2 is a schematic illustration identical to FIG. 1 except showing the system connected to an internal combustion engine fueled by methanol.

This invention is best described by referring to FIGS. 1–7 (inclusive) where FIGS. 1 and 2 schematically illustrate the flow of lubricant from the accumulator to the engine and back again. The accumulator prelubrication system is generally illustrated by reference numeral 10 as comprising a reservoir 12, a valve system 14 and conduit means 16, which can take the form of a flexible hose and suitable fittings (not shown) as seen in FIG. 1 or a conduit system including conduit 18, 20 and 22 and the splitter valve 26 adapted for a methanol engine shown in FIG. 2.

As is apparent from both FIGS. 1 and 2 lubricant is directed from the accumulator through the valve system at the bottom and through the conduit means to the lubrication system to the engines shown and then returned back to the accumulator again through the valve system as depicted by the solid and broken line arrows respectively. In both systems a manually operated electrical switch 28 energizes the solenoid for retracting a needle valve to prelubricate the engine which will be disclosed in further details hereinbelow. The engine pumping system once the engine is started, will pressurize the oil and the integral restrictive passage and check valve will allow the accumulator to be recharged with lubricant and held at the prerequisite pressure when the cycle is repeated.

Figure 3:
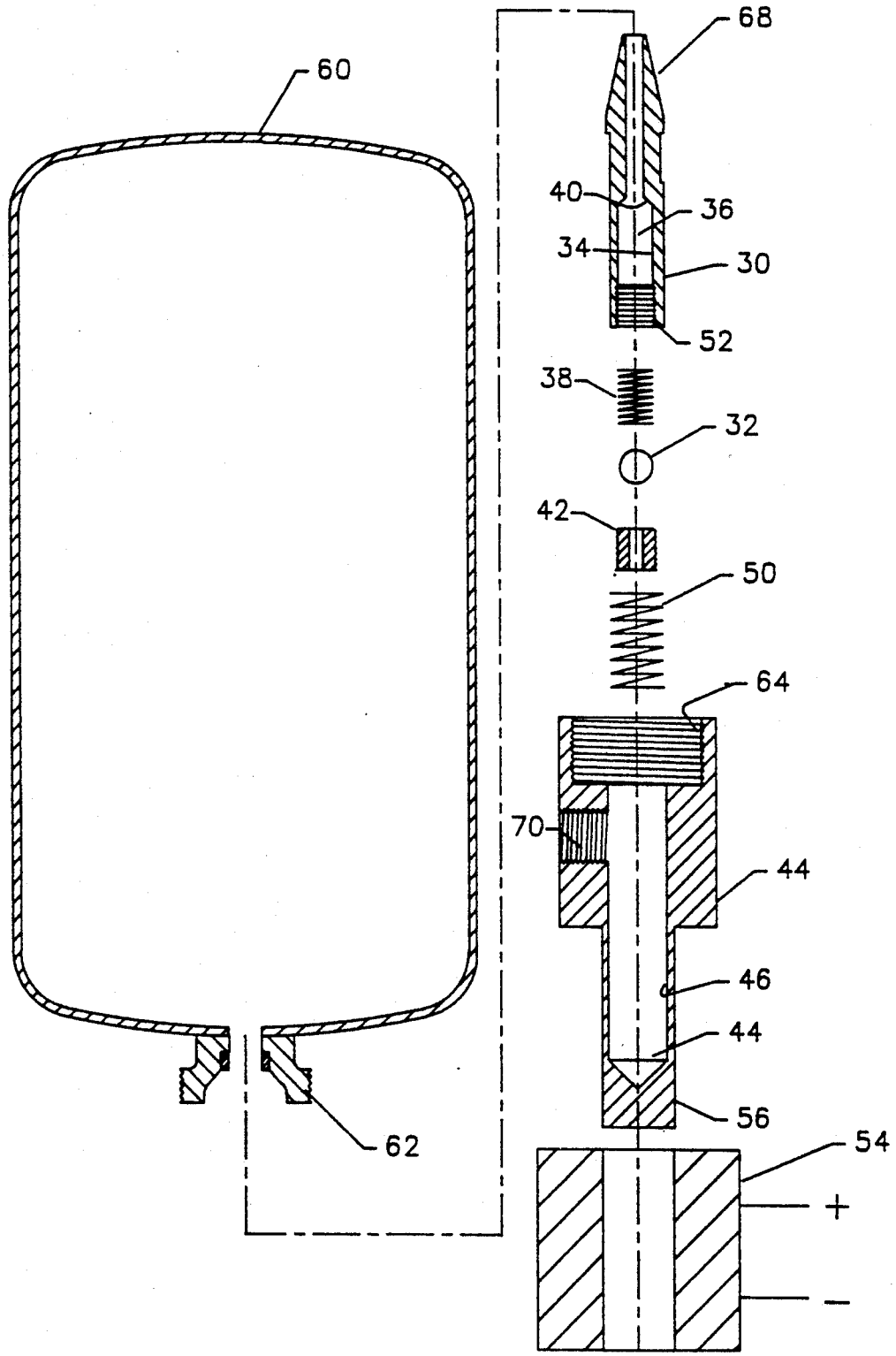
FIG. 3 is an exploded view in section showing the details of this invention.

The details of these elements are best seen by referring to the exploded view of FIG. 3 which shows the accumulator prelubrication system 10 as comprised of essentially two moving parts, the needle valve 30 and the ball check valve 32. As is apparent the ball check valve fits into the large diameter portion 34 of the central passageway 36 that extends axially through needle valve 30. Coiled spring 38 captured between shoulder 40 and the ball of ball check valve 32 serves to biased the ball against valve seat 42. Valve seat 42 is a set screw with a central through passageway that has a seat on one end cooperating with the ball and a recess on the opposite end for receiving an appropriate tool say an allen wrench for being threaded onto the internal threads formed in the side wall of the central bore at the end remote from the tapered end to the needle valve 30. The set screw also serves to adjust the coil spring 38 of the check valve to adjust the maximum pressure in the accumulator.

The valve housing 44 preferably fabricated from a nonmagnetic material such as aluminum consist of a central bore 46 axially extending just short of the end of the housing to form a top surface for defining a spring retainer 48. A second coil spring 50 whose spring rate is considerably higher than the spring rate of coil spring 38 fits into the spring retainer 48 to bear against the needle valve to bias needle valve 30 toward the closed position.

It is apparent from the foregoing that the only two moving parts fit into the valve housing 44 where the check valve fits into the needle valve 30. The valve housing 44 in turn carries a reduced diameter end portion that fits into the central portion of a suitable commercially available solenoid 54 and bonded into place by any suitable means as spot welded, brazed or by friction fit.

The accumulator 60 which preferably is a steel bottle of the type that is currently used for propane gas is mounted at the bottom to the valve body 44 by the fitting and valve seat combination 62. The fitting 44 is fitted into an increased diameter portion 64 of bore 46 and bonded into place as by welding brazing or by friction fit. A suitable resilient ring 66 or a suitable "O" ring may serve as the seat for the tapered end 68 of the needle valve 30 to prevent leakage from the accumulator and assure it maintains its maximum pressure.

Drilled passage 70 formed on the side wall of valve housing 44 accommodates the conduit means or hose 16 or 18 (FIGS. 1 or 2) for feeding lubricant to the engines and returning lubricant to the accumulator as will be explained in greater detail hereinbelow.

Figure 4:
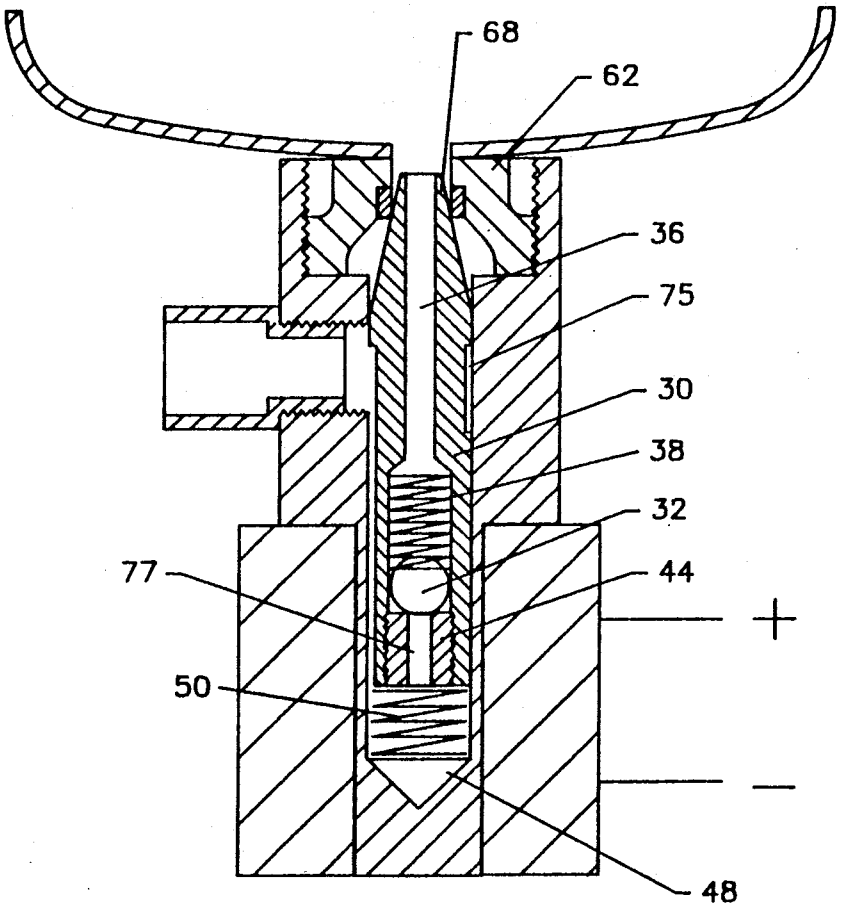
FIG. 4 is a partial view in section of the components assembled and illustrating the closed position.
Figure 5:
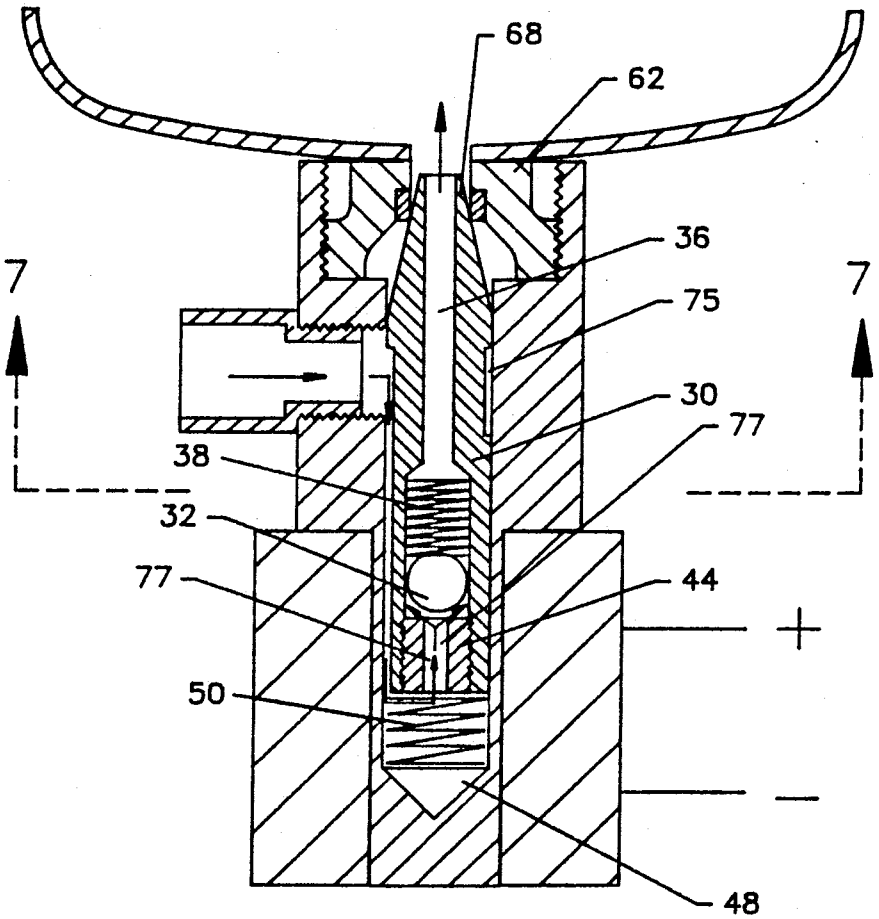
FIG. 5 is a partial view in section identical to FIG. 4 illustrating the filling position.
Figure 6:
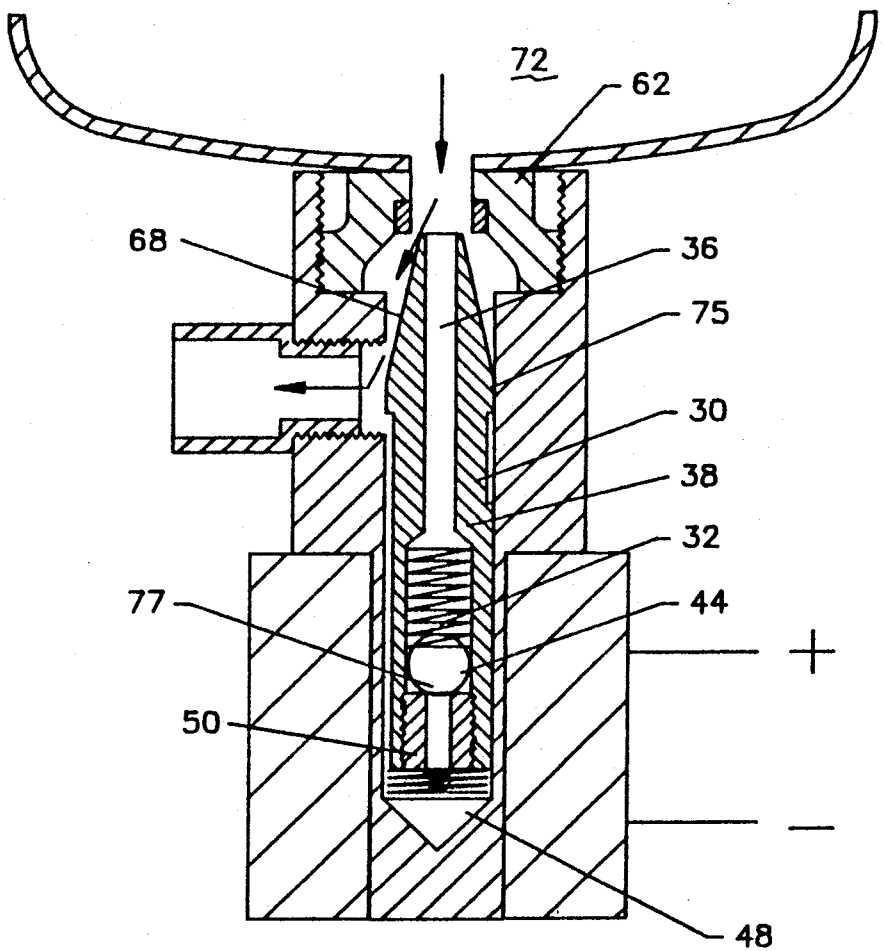
FIG. 6 is a partial view in section identical to FIGS. 4 and 5 illustrating the open position.

The operation of the accumulator prelubrication system is best seen by referring to FIGS. 4, 5 and 6 which shows the three operating positions, namely 1) closed, 2) filling and 3) open, respectively.

As can be seen in FIG. 4 the system is in the closed position where the only two moving parts, needle valve 30 and ball check valve 32 are in the closed position which is the condition when the accumulator is completely filled or the pressure in the conduit means is less than the pressure in the accumulator. When the accumulator is filled the forces of coil spring 38 and the pressure of the oil in passageway 36 acting on the top surface of the ball of the ball check valve 32 and the force of coil spring 50 urging needle valve 30 closed serve to assure that the pressure in the accumulator is at its maximum value.

As can be seen by FIG. 5 the ball of the ball check valve 32 is unseated owing to the fact that the pressure in the engine's lubrication system is higher than the pressure in the accumulator and oil will flow into the valve housing through the annular passageway 75 and into the central passage 77 of the valve seat 42 via a restrictive passageway 78. Passageway 78 is formed by milling a flat extending axially along the outer surface of the cylindrical wall of needle valve 30 which is shown in the sectional view in FIG. 7. The space between the flat milled section and the inner wall of the bore provide a wider passage that serves to prevent any back pressure of the stagnant air that accumulated during shut down to resist the movement of the needle valve when retracted. When the pressure acting on the bottom of ball 32 creates a force that is equal and opposite the force of coil spring 38 and the force created by the pressure in the reservoir 72 of the accumulator the ball will seat against the valve seat to return to the closed position. The pressure in the accumulator will remain at this value after the engine has been shut off.

FIG. 6 shows the prelubrication system when the system is actuated. When the switch 28 (FIG. 1) is depressed to connect the coil of the solenoid 54 to the battery and ground to produce and electromotive force for retracting the needle valve the tapered seated end of the valve will instantly unseat and the lubricant will be forced into the engine through valve seat 62, central bore 46, drilled passage 70 and the conduit systems depicted in either FIG. 1 or FIG. 2. As noted in the filling position since the oil is introduced to the accumulator from the bottom the air remaining in the reservoir 72 will be trapped and driven to the top and will compress to a value equal to or substantially equal to the pressure of the oil in the engine's lubricating system. The action of the pre oiling is very quick and occurs almost instantly.

This force serves to propel the oil back to the engine's lubricating system when the prelubrication cycle is initiated. Once the engine is started and the engine's pumping system is actuated the engine's pressure will rise and the accumulator will begin to refill and continue to fill until the system has attained its maximum value.

Figure 7:
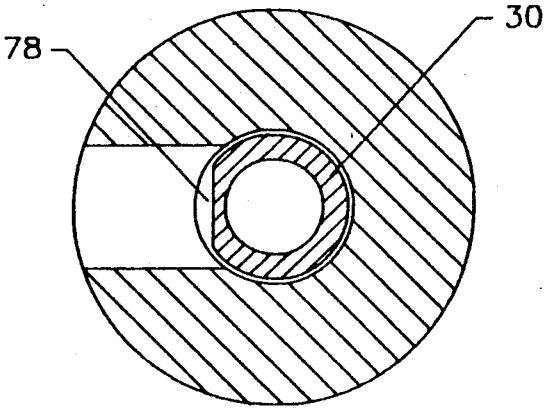
FIG. 7 is a sectional view taken along section lines 7—7 of FIG. 5.
Figure 10:
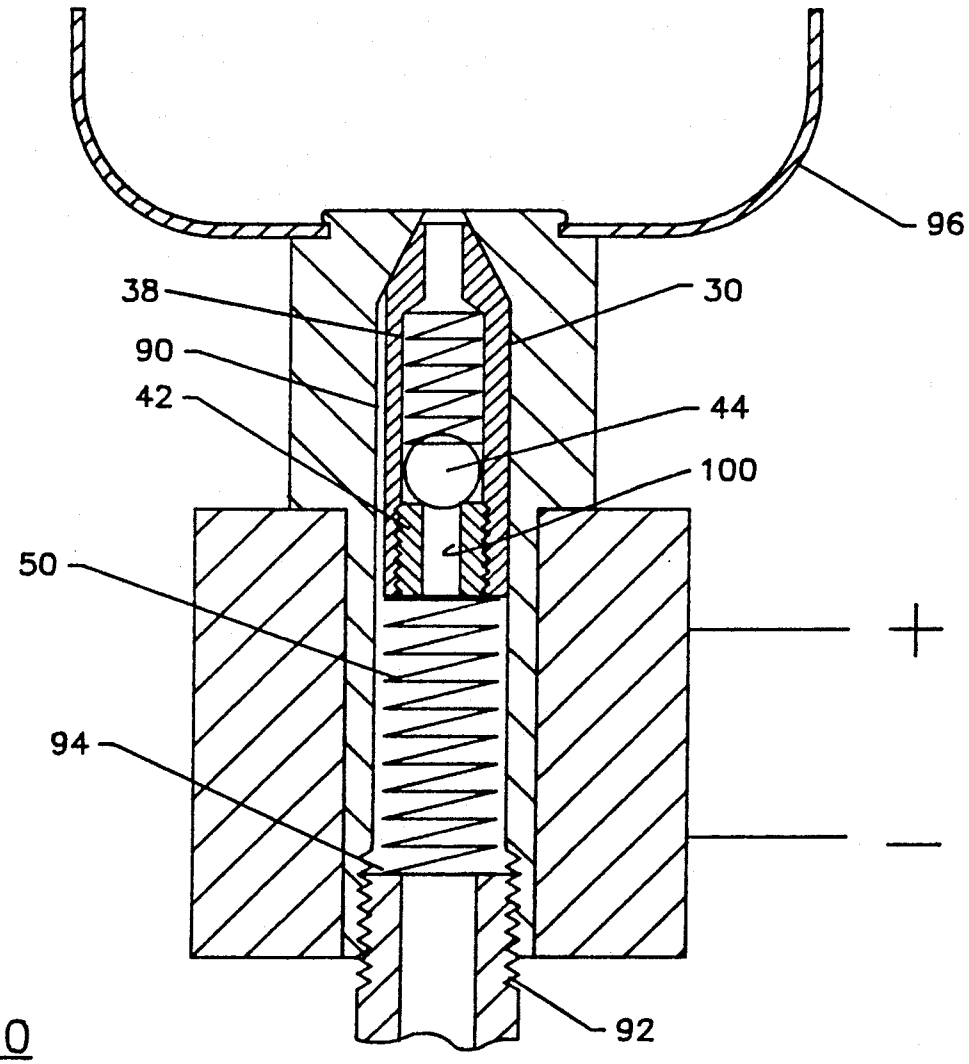
FIG. 10 is a partial view in section illustrating the details of another embodiment of this invention.

FIG. 10 exemplifies another embodiment where the bottle is integrated with the valve housing 44. (Like reference numerals refer to like parts in all the FIGS.). As noted from FIG. 10, the needle valve 90 extends axially straight through the valve housing 44. A threaded fitting 92 adapted to thread into complementary threads formed at the end of the bore in the valve housing 44 serves to accommodate a hose (not shown) connected to the conduit system for delivering and returning the lubricant. The inner end 94 of fitting 92 serves as the spring retainer and bears against the end of coil spring 50 to set the biasing force on needle valve 30. One or more flats similar to that shown in FIG. 7 are milled out from the surface of the needle valve 30 extending from the top of the tapered end to the top of needle valve 30.

The bottle 96 in this embodiment is fabricated to be integral with the valve housing 44. The end of valve housing 44 fits into a circular hole formed on the bottom of the bottle 96 and may be supported in place by crimping the side edges of the circular hole 98. In this instance the bottle 96 is made in two halves so that the crimping operation can precede the joining of the two halves. The two halves may then be bonded, say by welding, brazing or the like.

The central passage 100 in valve seat 42 is sized to restrict the flow of lubricant returning to the bottle 96.

Figure 8:
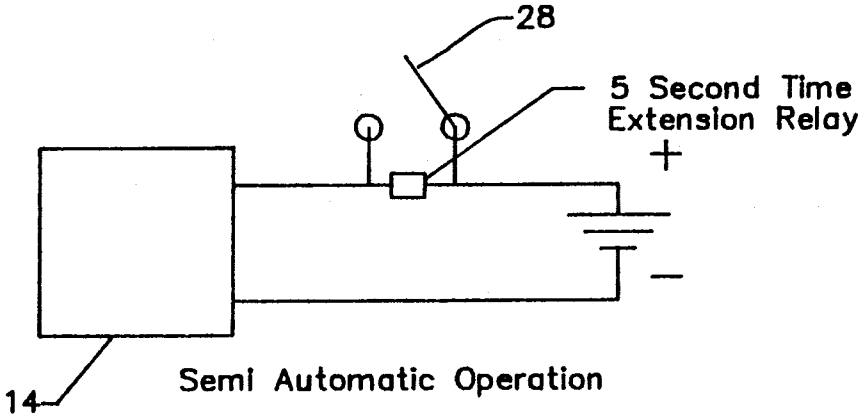
FIG. 8 is a schematic illustrating an electrical circuit with a time delay for use as an automatic system.
Figure 9:
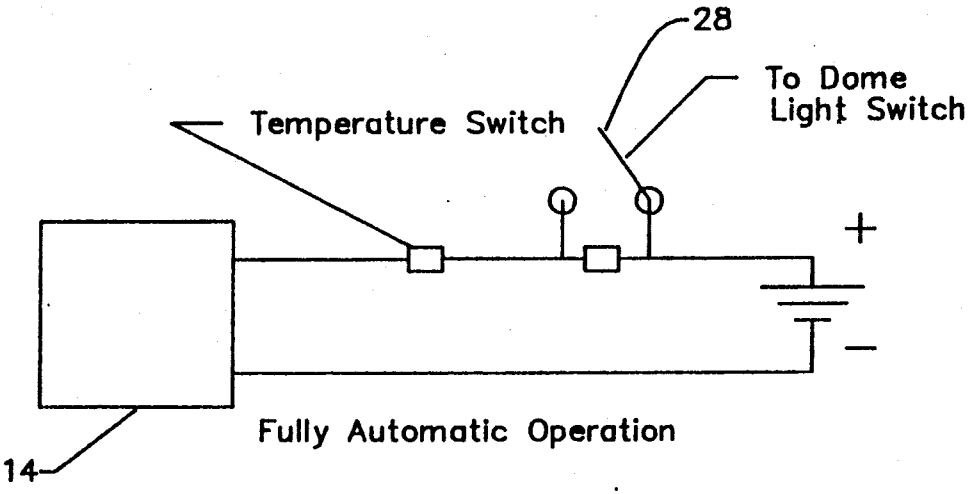
FIG. 9 is a schematic illustrating the identical system in FIG. 8 with the inclusion of a temperature override.

This invention contemplates several different actuation systems for initiating the prelubricating cycle. The systems depicted in FIGS. 1 and 2 are simple manually actuated systems that by depressing an electric switch connect the coil of the solenoid to the battery and ground. This type of system is adaptable in any type of ground or water vehicle. FIG. 8 illustrates a system that is intended to be totally automatic by incorporating an electrical relay 90 that is activated by opening the door of a ground vehicle. In this system the switch can be coupled to the vehicles' dome light circuit for example. FIG. 9 includes a suitable commercially available temperature override switch 92 that overrides the relay by holding open the electric circuit when the temperature reaches a predetermined level.

Although this invention has been shown and described with respect to detailed embodiments thereof it is to be understood that various modifications in form and detail will suggest themselves to those skilled in the art, and is intended by the appended claims to cover such modifications as come within the true spirit and scope of this invention.

What is claimed is:

1. An accumulator lubrication system in combination with an internal combustion engine including conduit means fluidly interconnecting the lubrication system of the internal combustion engine and the accumulator lubrication system for admitting lubricant prior to start-up of said engine comprising:

a cylindrical container defining a reservoir for accumulating the lubricant under pressure being mounted in close proximity to the exterior of said engine and oriented in a generally vertical position relative to the earth's horizon, a fitting mounted on the bottom of said container including a valve seat for admitting lubricant into said reservoir, a cylindrically shaped valve housing formed from a nonmagnetic material supported to said fitting, a needle valve formed from a magnetic material slidably mounted in a bore formed in said valve housing having a tapered end cooperating with said valve seat, first resilient means at one end remote from said tapered end of said needle valve urging said needle valve toward said valve seat to bias it in the closed position, check valve means mounted in a central passageway axially extending through said needle valve in fluid communication with said reservoir including another valve seat mounted in said central passageway at the end remote from said tapered end and including a ball member cooperating with said other valve seat, second resilient means acting on said ball member urging said ball member against said other valve seat to bias said check valve in the closed position, solenoid means mounted at the end of said valve housing remote from said tapered end and surrounding a portion of said needle valve, means including an actuation switch for energizing said solenoid to retract said needle valve to flow lubricant from said reservoir through said valve seat, through said bore, through a drilled passage formed on the side wall of said valve housing and through said conduit means, and fluid return means including said conduit means for leading lubricant from said engine back to said reservoir, through said drilled passageway, through a restrictive passage formed between the outer surface of said needle valve and inner surface of said bore, through said other valve seat, through said check valve and through said central passageway, whereby the second resilient means and the pressure of the fluid in said reservoir urges said check valve closed when the pressure in said reservoir reaches a value equal to the maximum value produced by the lubrication system of said engine.

2. An accumulator lubrication system as claimed in claim 1 wherein said needle valve is fabricated from a ferrous material and said valve housing is fabricated from aluminum or aluminum alloy material.

3. An accumulator lubrication system as claimed in claim 2 wherein said valve housing is closed on one end defining with said bore a spring retainer for supporting said first resilient means.

4. An accumulator lubrication system as claimed in claim 3 where said first resilient means is a coil spring having one end bearing against said spring retainer and the opposite end bearing against the end of said needle valve remote from said tapered end.

5. An accumulator lubrication system as claimed in claim 4 including a larger diameter portion in said central passageway defining a shoulder, said other resilient means being another coil spring having one end bearing against said shoulder and the other end bearing against said ball to urge said ball against said other valve seat.

6. An accumulator lubrication system as claimed in claim 5 including an electric circuit, a direct current electrical power source, an electrical on-off switch connecting said power source to said solenoid and ground.

7. An accumulator lubrication system as claimed in claim 6 including an electrical relay connected to said electric circuit to impart a time delay to said switch when positioned in said on position.

8. An accumulator lubrication system as claimed in claim 7 including a temperature responsive switch connected to said electrical circuit for overriding said switch when the temperature reaches a predetermined value.

9. An accumulator as claimed in claim 1 wherein said internal combustion engine is fueled by methanol and including a splitter valve fluidly connected to said conduit means for directing lubricating oil to the bottom and top of said methanol fueled internal combustion engine.

10. An accumulator lubrication system in combination with an internal combustion engine including conduit means fluidly interconnecting the lubrication system of the internal combustion engine and the accumulator lubrication system for admitting lubricant prior to start-up of said engine comprising:

a cylindrical container defining a reservoir for accumulating the lubricant under pressure being mounted in close proximity to the exterior of said engine and oriented in a generally vertical position relative to the earth's horizon, a cylindrically shaped valve housing formed from a nonmagnetic material having one end inserted in a circular hole in the bottom of said container and being supported therein.

a needle valve formed from a magnetic material slidably mounted in a bore formed in said valve housing having a tapered end cooperating with a valve seat formed on the end to said bore and being tapered to complement said tapered end, resilient means at one end remote from said tapered end of said needle valve urging said needle valve toward said valve seat to bias it in the closed position, check valve means mounted in a central passageway axially extending through said needle valve in fluid communication with said reservoir including another valve seat having a restrictive passage mounted in said central passageway at the end remote from said tapered end and including a ball member cooperating with said other valve seat, another resilient means acting on said ball member urging said ball member against said other valve seat to bias said check valve in the closed position, solenoid means mounted at the end of said valve housing remote from said tapered end and surrounding a portion of said needle valve, means including an actuation switch for energizing said solenoid to retract said needle valve to flow lubricant from said reservoir through said valve seat, through said bore, through passage means formed between the side surface of said needle valve and said valve housing and through said conduit means, and fluid return means including said conduit means for leading lubricant from said engine back to said reservoir, through said restrictive passage of said other valve seat, through said check valve and through said central passageway, whereby the other resilient means and the pressure of the fluid in said reservoir urges said check valve closed when the pressure in said reservoir reaches the maximum pressure produced by the engine lubrication system.

* * * * *